United States Patent [19]

Moss

[11] 4,306,747

[45] Dec. 22, 1981

[54] THERAPEUTIC SEAT

[76] Inventor: Lulu C. Moss, 106-18 27th Ave., East Elmhurst, N.Y. 11369

[21] Appl. No.: 123,939

[22] Filed: Feb. 25, 1980

[51] Int. Cl.[3] ..... A47C 7/72

[52] U.S. Cl. ..... 297/180; 128/377; 297/217

[58] Field of Search ..... 297/180, 217; 98/DIG. 11; 128/376, 377, 24.1, 68.1, 70; 126/205; 5/284

[56] References Cited

U.S. PATENT DOCUMENTS

| | | | |
|---|---|---|---|
| 2,267,158 | 12/1941 | Locke | 297/180 X |
| 2,488,964 | 11/1949 | Conrad | 128/377 X |
| 2,583,816 | 1/1952 | Butler | 98/DIG. 11 |
| 2,978,972 | 4/1961 | Hake | 297/180 X |
| 3,770,318 | 11/1973 | Fenton | 297/180 |

FOREIGN PATENT DOCUMENTS

| | | | |
|---|---|---|---|
| 1244352 | 7/1967 | Fed. Rep. of Germany | 297/180 |
| 2011004 | 9/1970 | Fed. Rep. of Germany | 297/180 |

*Primary Examiner*—James T. McCall

*Attorney, Agent, or Firm*—Marvin Feldman; Stephen E. Feldman

[57] ABSTRACT

A thermal therapeutic seating apparatus comprises a seating structure having a first air chamber and a headrest structure having a second air chamber. A heater is operatively associated with the seating structure to heat ambient air in the first air chamber. A heat distribution structure connects the second air chamber to the first air chamber to distribute heated air by natural connection whereby heated air flows from the first air chamber to the second air chamber and back to the first air chamber. This causes the seating element and the headrest element to be heated.

8 Claims, 3 Drawing Figures

THERAPEUTIC SEAT

DISCLOSURE DOCUMENT

The present invention received a disclosure document No. 082453.

BACKGROUND OF THE INVENTION

While the present invention is subject to a wide range of applications, it is especially suited for use in a therapeutic situation for sick or elderly people and will be particularly described in that connection.

People who are ill or confined to a chair often find comfort and relief when heat is applied to their body in general and to their head and posterior in particular. Thus, it is desirable to provide a chair which is heated both in its seat and along the headrest for people who might benefit from this provision. It is also important that the chair is able to have the heated regulated as required and that it can be moved without too much difficulty.

In the past, the prior art has disclosed different types of chairs which were heated.

For example, U.S. Pat. No. 2,544,506 to Kronhaus discloses for example, an "article of furniture incorporating as an integral part thereof means for heating or cooling the cushions so that ideal localized temperature control and application may be obtained." In this reference, the air is driven through and out of the chair either through holes 25 or through the fabric of the cushions.

U.S. Pat. No. 2,587,731 to Irving discloses an electrically heated chair wherein for example, the chair is "heated by drawing air into the article of furniture, heating and discharging the air through the covering of the article of furniture".

U.S. Pat. No. 2,782,834 to Vigo discloses for example, "a seat having a self-contained air conditioning unit and an automatic control for energizing the unit when a person seats himself".

It is an object of the present invention to provide a therapeutic seating apparatus wherein the natural convection creates the heat distribution.

It is a further object of the present invention to provide a thermal therapeutic seating apparatus having a heat distribution means which can heat different portions of the chair.

It is a still further object of the present invention to provide a thermal therapeutic seating apparatus which is relatively uncomplicated and therefore inexpensive to manufacture.

SUMMARY OF THE INVENTION

Accordingly, there has been provided a thermal therapeutic seating apparatus comprising a seating structure having a first air chamber, and a headrest structure having a second air chamber A heater is operatively associated with the seating structure to heat ambient air in the first chamber. A heat distribution structure connects the second air chamber to the first air chamber to distribute heated air by natural convection whereby heated air flows from the first air chamber to the second air chamber and back to the first air chamber. This causes the seating element and the headrest element to be heated.

For a better understanding of the present invention together with other and further objects thereof, reference is had to the following description, taken in connection with the accompanying drawings, while its scope will be pointed out in the appended claims.

DESCRIPTION OF THE PREFERRED EMBODIMENT OF THE INVENTION

Figure 2:
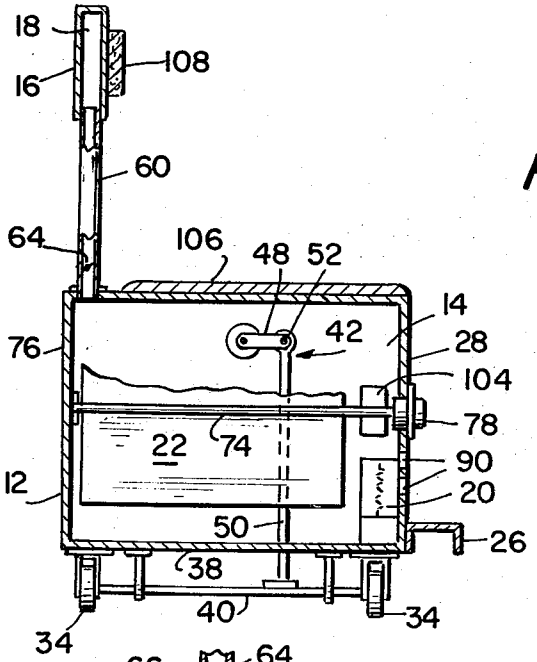
FIG. 2 is a view through 2—2 of FIG. 1.

A thermal therapeutic seating apparatus 10 comprises a seating structure 12 having a first air chamber 14. A headrest structure 16 has a second air chamber 18. A heater device 20 is operatively associated with the seating structure 12 to heat ambient air in the first chamber 14. A heat distribution structure 22 connects the second air chamber 18 to the first air chamber 14 and distributes heated ambient air by natural convection. This forces heated air to flow from the first air chamber to the second air chamber and back to the first air chamber and thereby heats the seating structure and the head structure.

Figure 1:
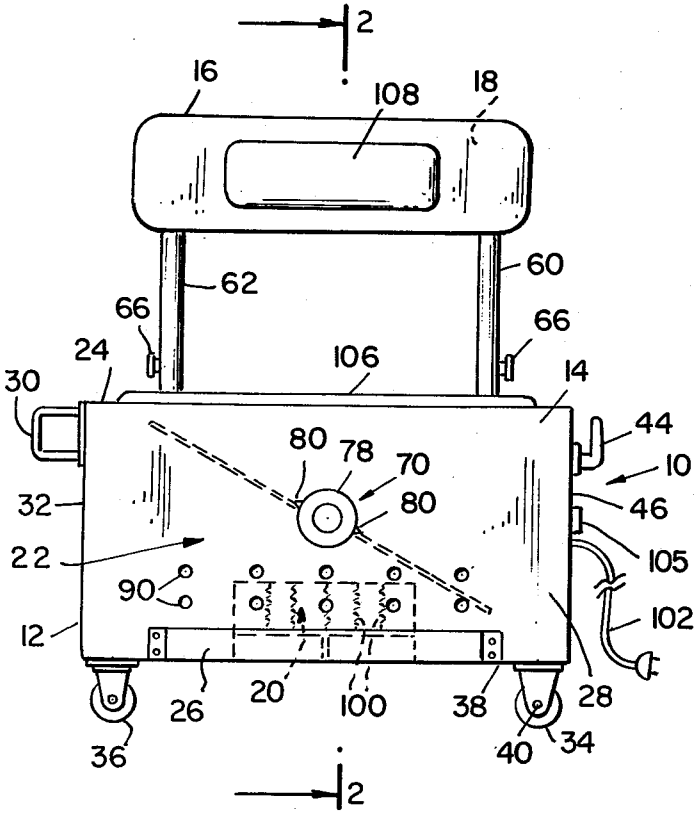
FIG. 1 is a front view of a thermal therapeutic seating apparatus in accordance with the present invention.

Referring to FIG. 1, there is illustrated a seating structure 12. The seating structure is a substantially enclosed box made of any desired material, such as for example, metal. The seating structure includes a top face 24 which may serve as a seating surface. A footrest 26 extends from a front surface 28 of the seating structure. This footrest may be of any desirable configuration and attached to the front surface in a conventional manner such as for example, bolting or welding. A handle 30 is attached to a side surface 32 of the seating structure and may be used to move the apparatus 10 as required. Two pairs of wheels 34 and 36 may be attached to the undercarriage 38 of the seating structure in any conventional manner. The wheels 34 may be connected by a axle 40 whereby the wheels 34 are restricted to forward and backward movement. On the other hand, the wheels 36 may be any conventional swivel type wheel to permit the seating structure to easily move in any direction. A braking device 42, associated with wheels 34, may include a brake handle 44 which extends from a side surface 46 of the seating structure 12. The brake handle may rotate and move brake rods 48 and 50 which are attached to each other through a pivot point 52. The brake rods push a brake pad 54 affixed to one end of the rod 50 against the axle 40 to lock the wheels 34 and stop the seating structure from moving. It is within the scope of the present invention to use any type of wheels and any conventional braking system as desired.

A headrest structure 16 is formed in a relatively rectangular box-like configuration having a second air chamber 18 therein. A pair of parallel separately disposed tubes 60 and 62 support the heat rest structure 16 above the seating structure 12. The hollow tubes may be made of any desirable material, such as for example steel and connected to the seating and headrest structures by any known technique such as, threads or welding. Each of the tubes may contain a butterfly valve 64 operated by a knob 66 extending on the outside of the tubes. Although a butterfly valve is illustrated in FIG. 2, it is within the scope of the present invention to use any type valve as desired.

Figure 3:
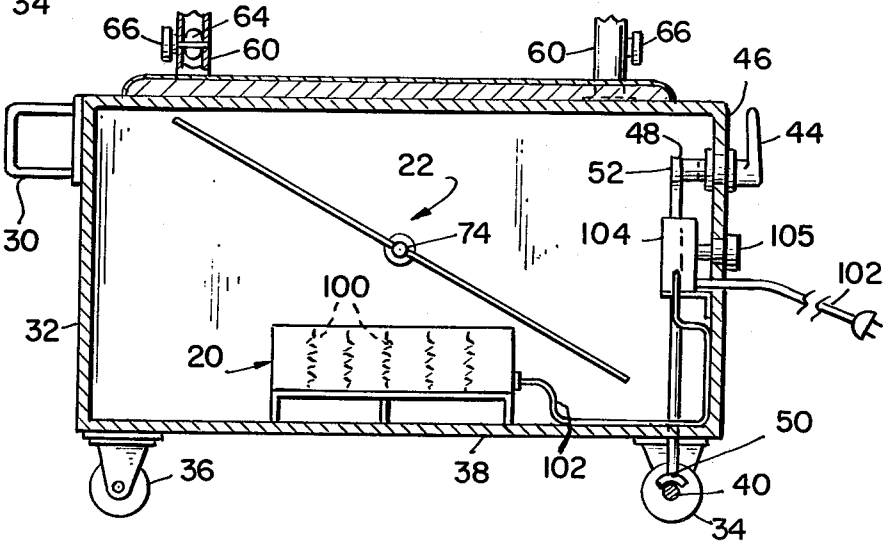
FIG. 3 is a front view of the inner components of the seat air chamber.

A heat distribution device 22 includes the hollow tubes 60 and 62 as well as the valves described above. The distribution device further comprises a baffle 70 which may be formed of a flat, rectangular member 72 as best seen in FIGS. 2 and 3. The baffle may be mounted on a pivot rod 74 which extends from the front surface 28 to the rear surface 76 of the seating structure. A baffle control knob 78 extends from the front surface 28 and includes pointers 80 to indicate the position of the flat member within the chamber 14. The distribution device 22 also includes air inlet openings 90 in the front surface 28 of the seating structure 12. Although a plurality of small circular openings are illustrated in FIG. 1 it is within the scope of the present invention to provide any number of desired openings of any suitable configuration.

A heater device 20 is located in the first chamber 14 preferably behind the air inlet openings 90. The heater device may be comprised of electrical heating coils 100 which receive power from an external electrical power source through an electrical cord 102. A heater control device 104 may regulate the amount of power going into the heater coils and thereby the amount of heat generated by the heater device. The heater control 104 can be regulated by an external knob 105 extending from the side surface 46 of the seating structure. It is further within the scope of the present invention to provide a conventional thermostatic control within control 104 whereby the heater turns either on or off when the temperature reaches predetermined limits. It is also contemplated that a rechargeable battery supply may be provided to generate the power for the heater device 20 so that the apparatus may be moved to any location and remain independent of a requirement for a electrical recepticle.

In order to make the seating and headrest structure more comfortable it is within the scope of the present invention to provide pillows 106 and 108 on the seat and head rest structures, respectively.

In order to more fully understand the present invention, the following description of its operation and use follows.

The baffle control knob 78 is placed into a position such as illustrated in FIG. 1. Then the heater 20 is turned on and the control knob 105 adjusted to provide the desired amount of power. The air in the first chamber 14 will begin to heat up. With the valves 64 in the tubes 60 and 62 opened, the natural convection causes the heated ambient air to flow from the chamber 14 through hollow tube 62 and into the air chamber 18. The air will continue to flow back through the tube 60 and into the air chamber 14. With the damper in position as shown in FIG. 1, the heated air will flow against the top face 24 and thereby heat the area where a person will be sitting, such as on the pillow 106. As the heat is moving through the structure as previously described, fresh air may be drawn into the air chamber 14 through the air inlet openings 90.

In the event that one side of the top surface 24, such as adjacent the tube 62 becomes too hot, it may be desirable to move the damper in the opposite position whereby the heat would flow through the tube 60 into the air chamber 18 and back through the tube 62. This ability to control the heat being directed onto one side of the top surface or the other has a distinct advantage when a person requires varying degrees of heat on different parts of his or her body. An additional feature of the present invention is that the knobs 66 may be turned to an off position whereby no heat flows into the second chamber 18. This may be desirable when a person does not want heat against his or her head.

In the event the temperature is too high or too low, the control knob 105 may be adjusted to change the amount of power being supplied to the heater coils 100 and thereby change the temperature in the first chamber.

The thermal therapeutic apparatus has an additional feature in that it can be easily moved around by means of the handle 30 since the seating structure 12 is mounted on wheels 34 and 36. Also, the braking handle 44 is readily accessible to either the individual sitting on the chair or an attendant to lock the chair in place.

Thus it can be seen by one skilled in the art that there has been provided a thermal therapeutic apparatus which uses natural convection of hot air for heat distribution, is able to heat different portions of the structure, and is relatively uncomplicated and inexpensive to manufacture.

While there has been described what is at present considered to be the preferred embodiment of the invention, it will be obvious to those skilled in the art that various changes and modifications may be made therein, without departing from the invention, and it is, therefore, aimed in the appended claims to cover all such changes and modifications as fall within the true spirit and scope of the invention.

What is claimed is:

1. A thermal therapeutic seating apparatus comprising:

(a) a seating structure having a first air chamber, (b) a headrest structure having a second air chamber, (c) heater means operatively associated with said seating structure to heat ambient air in said first chamber, (d) heat distribution means to connect said second air chamber to said first air chamber and to distribute heated ambient air by natural convection whereby heated air flows from said first air chamber to said second air chamber and back to said first air chamber causing said seating structure and said headrest structure to be heated, further characterized in that said heat distribution means includes two separately disposed hollow tubes supporting said headrest structure above said seating structure and being disposed at opposite ends of the seating structure, and in fluid communication with said first and second air chambers, further characterized in that said heat distribution means includes baffle means disposed in said first air chamber and extending between said two hollow tubes for directing the flow of heated air from said first air chamber selectively through one of said tubes to said second air chamber, and for selectively heating one portion of said seating surface adjacent one of said tubes, whereby said baffle means permits selective heated air movement to specific portions of the apparatus for therapeutic heating of parts of the body.

2. The thermal therapeutic seating apparatus as defined in claim 1 further characterized in that said heat distribution means further includes a valve means in each of said hollow tubes for regulating the amount of air flowing between said first and second air chamber.

3. The thermal therapeutic apparatus as defined in claim 1 further characterized in that said baffle means are movable for changing the direction of flow of said heated air from said first to said second air chamber through the second of said hollow tubes at another portion of said heating surface

4. The thermal therapeutic seating apparatus as defined in claim 1 further characterized in that said means to heat ambient air includes an electric heater located in said first air chamber.

5. The thermal therapeutic seating apparatus as defined in claim 4 further characterized in that said heater means further includes temperature control means operatively associated with said electric heater to regulate the temperature within the apparatus.

6. The thermal therapeutic seating apparatus as defined in claim 1 further characterized in that said heat distribution means further includes air inlet openings in said seating structure to allow the flow of ambient air into said first air chamber.

7. The thermal therapeutic seating apparatus as defined in claim 1 further characterized in that wheel means is connected to said seating structure for moving said apparatus.

8. The thermal therapeutic seating apparatus of claim 1, further comprising valve means to selectively discontinue heat to said second air chamber.

* * * * *